US010415820B2

(12) United States Patent
Yuan et al.

(10) Patent No.: US 10,415,820 B2
(45) Date of Patent: Sep. 17, 2019

(54) PROCESS FIRED HEATER CONFIGURATION

(71) Applicant: UOP LLC, Des Plaines, IL (US)

(72) Inventors: Quan Yuan, Buffalo Grove, IL (US); Matthew Martin, Tulsa, OK (US); Rajeswar Gattupalli, Buffalo Grove, IL (US); Charles M. Brabson, Humble, TX (US)

(73) Assignee: UOP LLC, Des Plaines, IL (US)

( * ) Notice: Subject to any disclaimer, the term of this patent is extended or adjusted under 35 U.S.C. 154(b) by 415 days.

(21) Appl. No.: 15/185,569

(22) Filed: Jun. 17, 2016

(65) Prior Publication Data

US 2017/0003017 A1 Jan. 5, 2017

Related U.S. Application Data

(60) Provisional application No. 62/186,528, filed on Jun. 30, 2015.

(51) Int. Cl.

| | |
|---|---|
| ***F22B 37/22*** | (2006.01) |
| ***F22B 37/16*** | (2006.01) |
| ***F22B 21/02*** | (2006.01) |
| *F22B 37/24* | (2006.01) |

(52) U.S. Cl.

CPC ..... *F22B 37/228* (2013.01); *F22B 21/02* (2013.01); *F22B 37/16* (2013.01); *F22B 37/22* (2013.01); *F22B 37/244* (2013.01)

(58) Field of Classification Search

CPC ..... F22B 37/228; F22B 37/16; F22B 37/22; F22B 37/244

USPC ..... 122/235.11, 235.15, 235.23, 249

See application file for complete search history.

(56) References Cited

U.S. PATENT DOCUMENTS

| | | | | |
|---|---|---|---|---|
| 3,285,847 | A | 11/1966 | Scofield et al. | |
| 3,475,135 | A | 10/1969 | Gargominy | |
| 4,499,055 | A | 2/1985 | DiNicolantonio et al. | |
| 5,147,511 | A | 9/1992 | Woebcke | |
| 5,151,158 | A | 9/1992 | Bowen et al. | |
| 5,181,990 | A | 1/1993 | Arisaki et al. | |
| 5,247,907 | A | 9/1993 | Lee et al. | |
| 5,979,548 | A * | 11/1999 | Rhodes | B29C 67/0014 165/284 |
| 6,026,804 | A * | 2/2000 | Schardt | F24H 1/40 126/344 |
| 7,297,169 | B2 | 11/2007 | Pham et al. | |

(Continued)

FOREIGN PATENT DOCUMENTS

| | | |
|---|---|---|
| CA | 1329317 C | 5/1994 |
| CN | 201885569 U | 6/2011 |

(Continued)

OTHER PUBLICATIONS

Garg, "Get the Most From Your Fired Heater", Chemical Engineering, Mar. 2004.

*Primary Examiner* — Steven B McAllister
*Assistant Examiner* — Benjamin W Johnson

(57) ABSTRACT

An apparatus for a fired heater is presented. The fired heater is designed with process coils inside a shell, and with a positioning of the burners for reducing the size of the fired heater. The shell has a general rectangular prismatic shape with combustion inlets for admitting combustion gases from the burners, and the process coils include at least two inlet ports and at least one outlet port.

10 Claims, 3 Drawing Sheets

(56) References Cited

U.S. PATENT DOCUMENTS

| | | | | |
|---|---|---|---|---|
| 7,964,091 | B2 | 6/2011 | Barendregt et al. | |
| 8,323,365 | B2 | 12/2012 | Drnevich et al. | |
| 8,490,581 | B2 | 7/2013 | Chhotray et al. | |
| 8,703,064 | B2 | 4/2014 | Payne | |
| 2008/0207974 | A1 | 8/2008 | McCoy et al. | |
| 2014/0045133 | A1 | 2/2014 | Myszka et al. | |
| 2015/0362176 | A1* | 12/2015 | Gauthier | F22D 1/02 122/421 |

FOREIGN PATENT DOCUMENTS

| | | | |
|---|---|---|---|
| DE | 19512219 | C1 | 4/1996 |
| EP | 47359 | B1 | 3/1984 |
| GB | 1500604 | A | 2/1978 |

* cited by examiner

PROCESS FIRED HEATER CONFIGURATION

CROSS-REFERENCE TO RELATED APPLICATION

This application claims priority from Provisional Application No. 62/186,528 filed Jun. 30, 2015, the contents of which are hereby incorporated by reference.

FIELD OF THE INVENTION

The present invention relates to fired heaters for use in chemical processes.

BACKGROUND

Fired heaters are common process units in chemical plants. The fired heaters heat process streams to reaction temperatures, and provide heat to process streams that have endothermic reactions. A fired heater has a general configuration of a tube for carrying a process fluid inside a shell wherein burners are used to combust a fuel to heat the tubes.

With more complex processes, and with upgrades to processes in chemical plants, new configurations are needed to reduce the area taken up by fired heaters, and to provide for new efficiencies in the heating of process fluids.

SUMMARY

The present invention is a new apparatus for a fired burner to heat a process stream. A first embodiment of the invention is an apparatus for heating a process fluid, comprising a shell having sides, an upper surface, a lower surface, combustion fluid inlets and a flue gas outlet, wherein the combustion inlets are for admitting a fuel and oxidant mixture; at least one process coil comprising at least two inlet ports and at least one outlet port less than the number of inlet ports, and disposed within the shell; and at least two burners disposed on the sides of the shell, and in an opposing configuration. The burners can be in a symmetrical opposing configuration, or in a staggered opposing configuration. An embodiment of the invention is one, any or all of prior embodiments in this paragraph up through the first embodiment in this paragraph wherein the process coil inlet ports and the outlet port are disposed on the lower surface of the shell. An embodiment of the invention is one, any or all of prior embodiments in this paragraph up through the first embodiment in this paragraph wherein the process coil inlet ports and the outlet port are disposed on the upper surface of the shell. An embodiment of the invention is one, any or all of prior embodiments in this paragraph up through the first embodiment in this paragraph wherein the flue gas outlet is disposed on the upper surface of the shell. An embodiment of the invention is one, any or all of prior embodiments in this paragraph up through the first embodiment in this paragraph wherein the flue gas outlet is disposed on the lower surface of the shell. An embodiment of the invention is one, any or all of prior embodiments in this paragraph up through the first embodiment in this paragraph wherein the process coil has a configuration of at least three tubes in a parallel orientation, with two semi-circular tubular sections connecting the ends of the tubes, such that the tubes and tubular sections form a coil having a general configuration of a W, and the inlet tubes having one end each connected to an inlet port and the central outlet tube having one end connected to an outlet port. An embodiment of the invention is one, any or all of prior embodiments in this paragraph up through the first embodiment in this paragraph wherein the central outlet tube has a diameter larger than the inlet tube diameters. An embodiment of the invention is one, any or all of prior embodiments in this paragraph up through the first embodiment in this paragraph wherein the shell has a substantially rectangular prismatic shape, with a height, a depth and a width, and wherein the process coils extend at least 70% of the height, and the process coils are arranged across the width with the central tubes arrayed along an axis that is in the middle of the width of the shell, and wherein the smaller tubes are arrayed in a position between 5% and 95% of the distance of the half-width of the shell. An embodiment of the invention is one, any or all of prior embodiments in this paragraph up through the first embodiment in this paragraph wherein the two smaller tubes have substantially the same inner diameter, and the central tube has an inner diameter between 1 and 2 times the diameter of the smaller tubes. An embodiment of the invention is one, any or all of prior embodiments in this paragraph up through the first embodiment in this paragraph wherein the shell has a substantially rectangular prismatic shape, with a height, a depth and a width, and wherein the burners are disposed on opposite sides of the width of the shell, and wherein the burners are disposed within 10% of the height of the from the bottom of the shell. An embodiment of the invention is one, any or all of prior embodiments in this paragraph up through the first embodiment in this paragraph wherein the apparatus further includes at least a second pair of burners disposed on opposite sides of the width of the shell and at a height between 30% and 80% of the height from the bottom of the shell. An embodiment of the invention is one, any or all of prior embodiments in this paragraph up through the first embodiment in this paragraph wherein the shell has a substantially rectangular prismatic shape, with a height, a depth and a width, and wherein the burners are disposed on opposite sides of the width of the shell. An embodiment of the invention is one, any or all of prior embodiments in this paragraph up through the first embodiment in this paragraph further comprising a first manifold having an inlet and multiple outlets, wherein each outlet is in fluid communication with the first inlet port of the process coil; a second manifold having an inlet and multiple outlets, wherein each outlet is in fluid communication with the second inlet port of the process coil; and a third manifold having multiple inlets and an outlet, wherein each inlet is in fluid communication with the outlet of the process coil. An embodiment of the invention is one, any or all of prior embodiments in this paragraph up through the first embodiment in this paragraph wherein the shell has a substantially rectangular prismatic shape, with a height, a depth and a width, and wherein there are up to 120 coils and at least one pair of burners for every 8 coils. An embodiment of the invention is one, any or all of prior embodiments in this paragraph up through the first embodiment in this paragraph wherein the shell has a substantially rectangular prismatic shape, with a height, a depth and a width, and wherein there are up to 120 coils and at least two pairs of burners for every 16 coils. An embodiment of the invention is one, any or all of prior embodiments in this paragraph up through the first embodiment in this paragraph wherein the shell has a substantially rectangular prismatic shape, with a height between 8 m and 25 m, a depth 0.1 m to 0.5 m/coil, and a width between 6 m and 20 m.

A second embodiment of the invention is an apparatus for heating a process fluid, comprising a shell having sides, an upper surface, a lower surface, combustion fluid inlets and a flue gas outlet, and wherein the shell has a substantially rectangular prismatic shape, with a height, a depth and a width; a plurality of process coils comprising two inlet ports, a first inlet port and a second inlet port, and one outlet port, and disposed within the shell, wherein each coil is arrayed in a plane across the width of the shell; and at least two burners disposed on the sides of the shell, and in an opposing configuration. An embodiment of the invention is one, any or all of prior embodiments in this paragraph up through the second embodiment in this paragraph wherein the coils have the inlet ports and outlet port on the upper surface, and the flue gas outlet is centered on the lower surface. An embodiment of the invention is one, any or all of prior embodiments in this paragraph up through the second embodiment in this paragraph further comprising a first manifold having an inlet and multiple outlets, wherein each outlet is in fluid communication with the first inlet port of the process coil; a second manifold having an inlet and multiple outlets, wherein each outlet is in fluid communication with the second inlet port of the process coil; and a third manifold having multiple inlets and an outlet, wherein each inlet is in fluid communication with the outlet of the process coil. An embodiment of the invention is one, any or all of prior embodiments in this paragraph up through the second embodiment in this paragraph wherein the burners are disposed on opposite sides of the width of the shell, and wherein the burners are disposed less than 10% of the height of the from the bottom of the shell.

Other objects, advantages and applications of the present invention will become apparent to those skilled in the art from the following detailed description and drawings.

DETAILED DESCRIPTION

Figure 1:
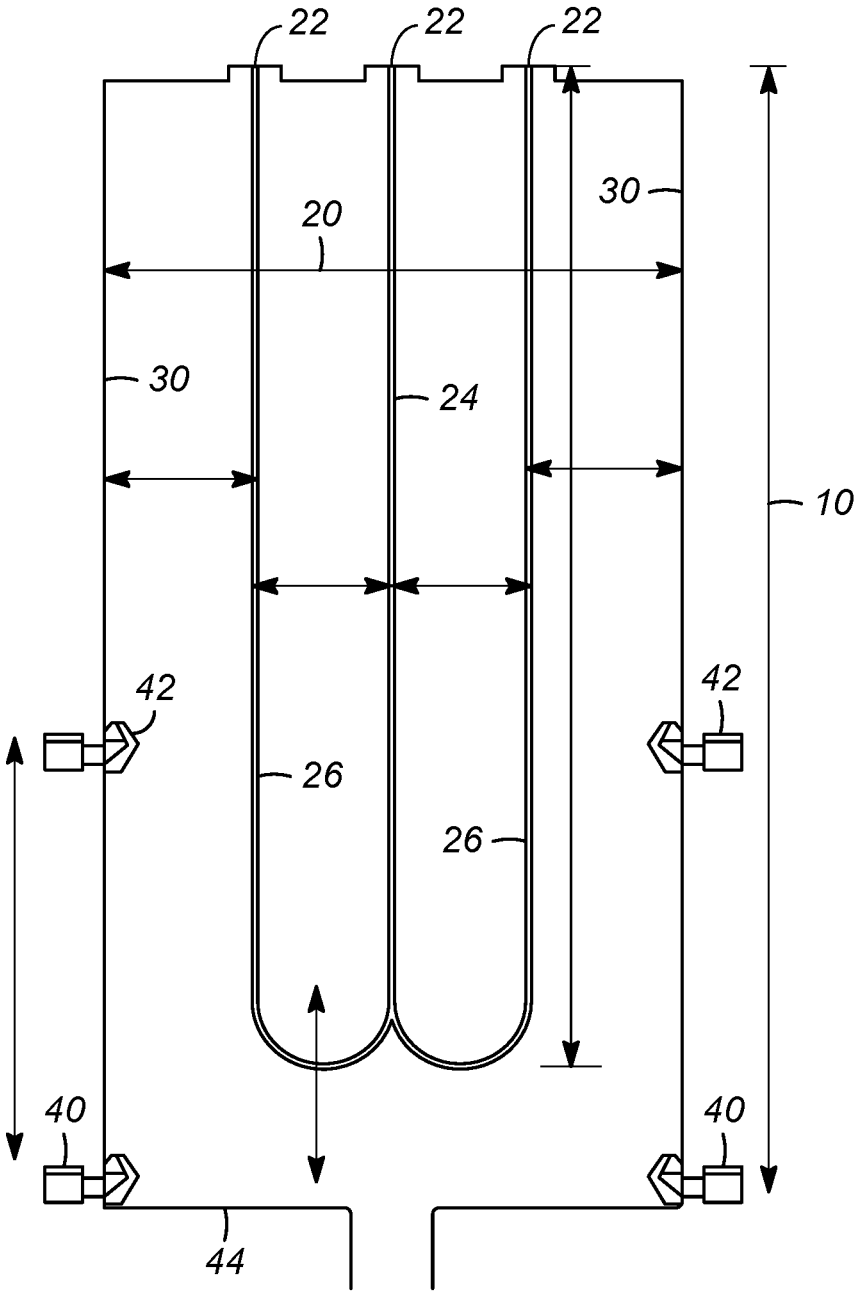
FIG. 1 is a cross-sectional view of the apparatus.

Chemical processes frequently need heating. Process heaters are designed to heat feed streams or intermediate process streams to temperatures necessary for the chemical reactions in the processes to occur at a reasonable rate. Most fired process heaters are equipped with "U-shaped" coils that allow for a process fluid to be heated. The coils are mounted in fired heaters that include burners. A fired heater is typically a box-shaped furnace with the coils inside the box and burners mounted on the sides or bottoms of the furnace. For a commercial process, a fired heater can be a very large item.

In a commercial hydrocarbon processing unit, fired heaters can represent a major portion of the capital cost. Redesigned heaters can reduce the losses and proved for more desirable capital cost, operation costs and reduced area, or smaller plot space, required for a heater.

The present invention provides a new heater configuration that includes a change in the coil geometry and burner positioning. The present invention is an apparatus for a fired heater to heat a process fluid. The apparatus includes a shell having a generalized rectangular prismatic shape with an upper surface, a lower surface, and sides. The shell includes inlets for admitting a combustion fluid, and a flue gas outlet. The flue gas outlet can be disposed on the upper surface or the lower surface of the shell. The flue gas outlet can also be positioned in one or more of the sides and within 10% of the height of the top of the sides. The apparatus further includes at least one process coil wherein the process coil includes at least two inlet ports and at least one outlet port. The inlet ports and the outlet port are in fluid communication with openings, or ports disposed in the shell surfaces. The apparatus further includes at least two burners disposed on the sides of the shell having burner outlets in fluid communication with the shell inlets for admitting the combustion fluid. The at least two burners are arranged in an opposing configuration, or on opposite sides of the shell. In an alternate arrangement, the burners can be disposed on the lower surface, and on opposite sides of the shell in either a symmetrical orientation or a staggered orientation.

In one embodiment, the process coil inlet ports and the outlet port are disposed on the upper surface of the shell. The process coil has a configuration of at least three tubes in a parallel orientation, with two rounded, or semi-circular, tubular sections connecting the ends of the tubes, such that the tubular sections combined with the tubes for a coil having a general configuration of the letter W, with the inlet tubes having one end each connected to an inlet port and the central outlet tube having one end connected to an outlet port. The central outlet tube can have a diameter larger than the inlet tube diameters, and the central outlet tube can have an inside diameter between 1 and 2 times the diameter of the smaller inlet tubes. The diameter of the inlet tubes is typically in the range of 2" NPS (nominal pipe size) to 7" NPS.

A cross-section of the apparatus can be seen in FIG. 1, showing one of the process coils 22. The shell of the apparatus has a substantially rectangular prismatic shape, having a height 10, a width 20, and a depth (not shown in the figure). The process coils 22 extend at least 70% of the height 10, and the process coils are arranged across the width 20 of the shell. The central tubes 24 of the process coils are arrayed near an axis along the middle of the width 20 of the shell. The inlet tubes 26 are arrayed between the center of the shell and the shell wall 30. The inlet tubes 26 are positioned between 5% and 95% of the distance of the half-width of the shell from the shell wall 30.

The apparatus includes burners 40, and the burners 40 are disposed on the sides of the shell. The burners 40 are disposed on opposite sides of the shell with a pair of burners 40 disposed within 10% of the height 10 of the shell from the bottom 44 of the shell. The apparatus can include a second pair of burners 42 disposed on opposite sides of the shell. The second pair of burners 42 are located at an elevated position relative to the first pair of burners 40, and are disposed at a position between 30% and 80% of the height 10 from the bottom 44 of the shell.

Figure 2:
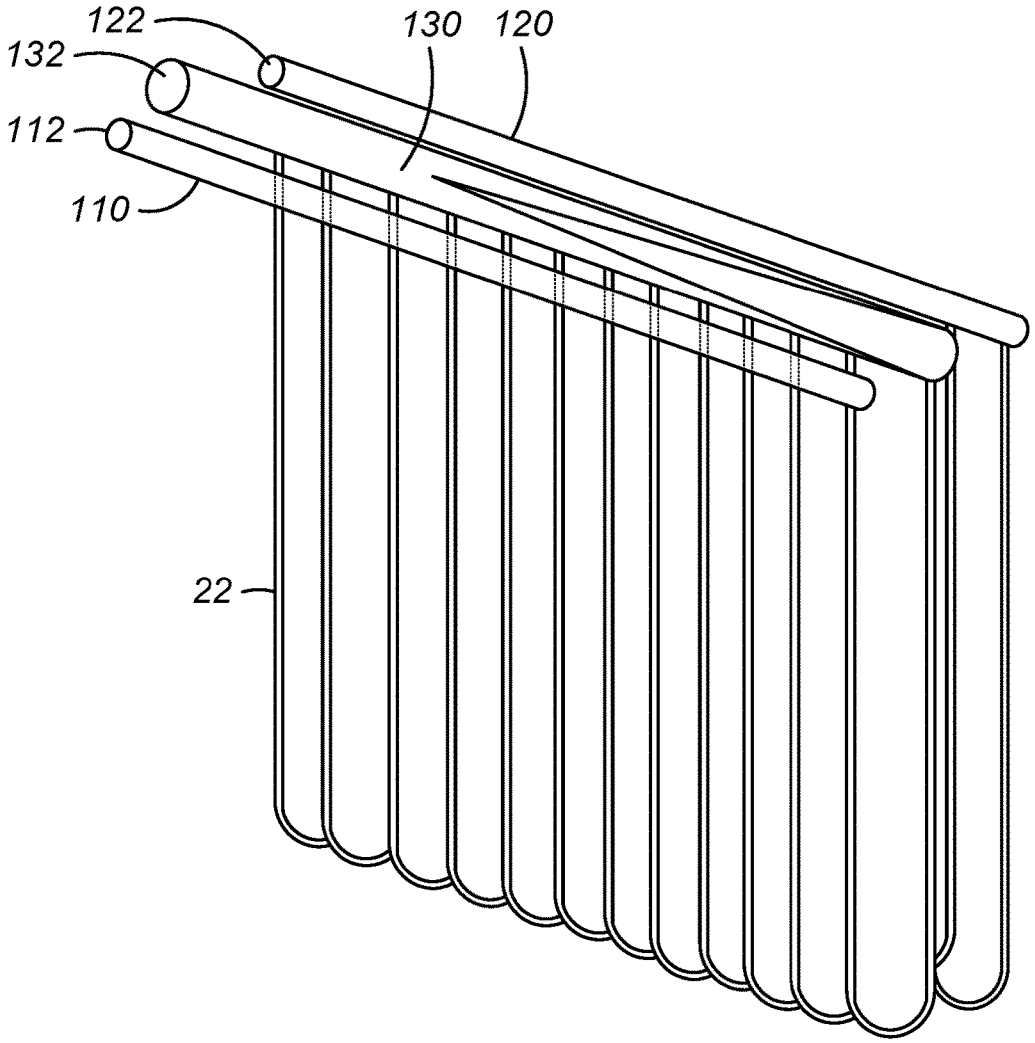
FIG. 2 is a drawing of the coils and manifolds for admitting and withdrawing the process stream to be heated in the apparatus.

The apparatus can include a plurality of coils, with upwards of 120 coils. As shown in FIG. 2, the coils have inlets and outlets. The apparatus further includes a first manifold 110 have an inlet 112 and a plurality of outlets, wherein each outlet is in fluid communication with the first inlet port of a process coil 22. The apparatus further includes a second manifold 120 having an inlet 122 and a plurality of outlets, wherein each outlet is in fluid communication with the second inlet port of a process coil 22. The apparatus further includes a third manifold 130 having multiple inlets and an outlet 132, wherein each inlet is in fluid communication with the outlet of a process coil. 22.

The fired heater provides a high temperature combustion from burners placed at interval along the sides of the shell. The apparatus includes at least one pair of burners for every 8 process coils, with up to 120 process coils and the process coils are arranged along the depth of the box with a certain minimum spacing between the coils. The burners are in pairs on opposing sides of the shell, and can be arrayed to have two opposing pairs of burners with a second pair in an elevated position relative to the first pair of burners. The apparatus can include at least two of the pairs of burners for every 16 coils. While one arrangement has the second pair of burners disposed directly over the first pair of burners and spaced at a distance between 10% and 70% of the height of the shell, another arrangement has the second pair of burners offset along the depth of the shell relative to the first pair of burners.

The shell has a substantially rectangular prismatic shape, or is a box like structure, with a height 10 between 8 m and 25 m, a width 20 between 6 m and 20 m, and a depth between 0.1 m and 0.5 m per coil in the apparatus. For a shell with 120 coils disposed within the shell the depth will be between 12 m and 60 m.

The preferred geometry of the apparatus is for coils having two inlet legs and one outlet leg. The coils are arrayed across the width of the shell and the burners in the apparatus are positioned in the side walls on the opposite sides of the width of the shell. The burners provide a heated combustion gas that circulates in the shell and exits a flue gas outlet. The hot circulating gas heats the coils and the fluid inside the coils. The burner position is related to the coil geometry, and the burners are positioned against the radiant section of the sides, and radiate and convect heat to the coils. It is preferred to use flat-flame burners for the lower pairs of burners near the lower surface of the shell, and either flat-flame burners or radial flame burners at the position above the first pair of burners. In traditional U-tube designs with end wall burners, the average circumferential heat flux is similar that the inlet and outlet legs. In the present invention with the floor fired burner arrangement, the average circumferential heat flux at the inlet legs is much higher than the average heat flux at the outlet legs, which helps in reducing the surface area of the coils when compared to traditional designs.

Figure 3:
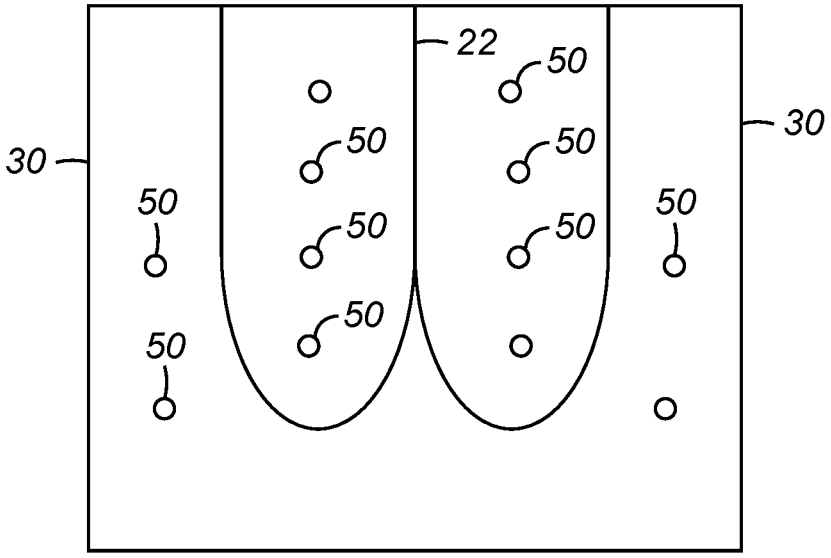
FIG. 3 is a schematic of one array of round flame end wall burners, from one side of the fired heater shell.

In another embodiment, the burners are positioned in the side walls of the opposite sides of the depth of the shell. These burners are typically round flame end wall fired burners. FIG. 3 gives an indication of the arrangement of the end-wall burners on one end-wall. In FIG. 3, a cross-section showing the sides 30, and a process coil 22. The burners 50 are on the end walls of the depth of the shell. The burners 50 can project from the end wall and provide heating between the legs of the coils 22. Burners are disposed on opposite end walls of the shell of the fired heater.

In one embodiment, the flow pattern is generated to have the hot combustion gases flow up along the inlet legs of the coils and down along the outlet leg of the coil in a large order circulation with smaller circulation flows around the coils, and out the flue gas outlet in the bottom of the shell. In another embodiment, the combustion gas circulates around the coils and exits a flue gas outlet disposed near the top of the shell sides. The preferred flue gas outlet is at the bottom of the shell, which improves the efficiency of the radiant box when compared to the flue gas outlet at the top of the shell.

The invention provides for a smaller heater, in volume, while still delivering a desired heating capacity, as the heater design is no longer limited by coils that have the highest absorbed duty. This provides for a more uniform delivery of heat to all the coils in the apparatus. A comparison was made with a standard commercial fired heater.

TABLE 1

Comparison of a new charge heater designed using this invention against a baseline charge heater for a 750 kmta propane dehydrogenation unit.

| | Baseline | Present Invention |
|---|---|---|
| Gas Inlet Temperature (° C.) | 558 | 558 |
| Process Gas Outlet Temperature | 630 | 630 |
| Radiant Section Efficiency | 60.70% | 60.90% |
| Coils Surface Area Relative to Baseline | 100% | ~72% |
| Radiant Box Surface Area Relative to Baseline | 100% | ~48% |

TABLE 2

Comparison of efficiency in the new heater for top and bottom flue gas duct with floor fired burners.

| | Top flue gas Duct | Bottom flue gas duct |
|---|---|---|
| Gas Inlet Temperature (° C.) | 558 | 558 |
| Process Gas Outlet Temperature | 630 | 630 |
| Radiant section efficiency | 60.9% | 48.9% |

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. An apparatus for heating a process fluid, comprising:

a shell having sides, an upper surface, a lower surface, combustion fluid inlets and a flue gas outlet, wherein the combustion fluid inlets are for admitting a fuel and oxidant mixture and wherein the shell has a height, a width, a top and a bottom;

at least one process coil disposed within the shell that comprises at least two inlet ports and at least one outlet port less than the number of inlet ports, wherein the at least one outlet port is located between the at least two inlet ports; and at least two burners disposed on the sides of the shell, and in an opposing configuration;

wherein the at least two inlet ports and the at least one outlet port of the at least one process coil are disposed on the lower surface of the shell wherein the at least one process coil comprises at least three tubes in a parallel orientation and two semicircular tubular sections, wherein a first tube and a second tube of the at least three tubes are inlet tubes that each have a first closed end and a second end connected to one of the at least two inlet ports, wherein each of the first tube and the second tube are connected to one of the two semicircular tubular sections between their respective first end and second end, wherein a third tube of the at least three tubes is a central outlet tube disposed between the first and second tubes that is connected to both of the two semi-circular tubular sections and has an end connected to the at least one outlet port such that the at least three tubes and the two semi-circular tubular sections form a general configuration of a letter W, and wherein the first and second tubes have substantially the same inner diameter.

2. The apparatus of claim 1 wherein the flue gas outlet is disposed on the upper surface of the shell.

3. The apparatus of claim 1 wherein the flue gas outlet is disposed on the lower surface of the shell.

4. The apparatus of claim 1 wherein the third tube has a diameter larger than the inner diameter of the first and second tubes.

5. The apparatus of claim 1 wherein the shell has a substantially rectangular prismatic shape, and wherein the at least one process coil extends at least 70% of the height, is arranged across the width with the third tube arranged along an axis that is in the middle of the width of the shell, and wherein the first and second tubes are arranged in a position between 5% and 95% of a distance between the axis and one side of the shell.

6. The apparatus of claim 1 wherein the third tube has an inner diameter between 1 and 2 times the inner diameter of the first and second tubes.

7. The apparatus of claim 1 wherein the shell has a substantially rectangular prismatic shape, and wherein the at least two burners are disposed on opposite sides of the width of the shell, and wherein the burners are disposed within 10% of the height of the shell from the bottom of the shell.

8. The apparatus of claim 7 wherein the apparatus further includes at least two additional burners disposed on opposite sides of the width of the shell and at a height between 30% and 80% of the height of the shell from the bottom of the shell.

9. The apparatus of claim 1 wherein the shell has a substantially rectangular prismatic shape, and wherein the at least two burners are disposed on opposite sides of the shell.

10. The apparatus of claim 1 wherein the shell has a height between 8 m and 25 m, a depth 0.1 m to 0.5 m/coil, and a width between 6 m and 20 m.

* * * * *